US009681691B1

(12) United States Patent
Hubbs

(10) Patent No.: US 9,681,691 B1
(45) Date of Patent: Jun. 20, 2017

(54) BRASSIERE FOR REDUCING SKIN WRINKLES IN DÉCOLLETAGE REGION OF CHEST

(71) Applicant: Jane Kristen Hubbs, Newport Coast, CA (US)

(72) Inventor: Jane Kristen Hubbs, Newport Coast, CA (US)

(73) Assignee: JANE KRISTEN HUBBS, Newport Coast, CA (US)

( * ) Notice: Subject to any disclaimer, the term of this patent is extended or adjusted under 35 U.S.C. 154(b) by 0 days.

(21) Appl. No.: 15/044,062

(22) Filed: Feb. 15, 2016

(51) Int. Cl.

| | |
|---|---|
| ***A41C 3/10*** | (2006.01) |
| ***A41C 3/00*** | (2006.01) |
| ***A41C 3/12*** | (2006.01) |
| ***A41C 3/14*** | (2006.01) |

(52) U.S. Cl.
CPC ..... *A41C 3/005* (2013.01); *A41C 3/0014* (2013.01); *A41C 3/12* (2013.01); *A41C 3/14* (2013.01)

(58) Field of Classification Search
USPC .... 450/39, 40, 54, 55, 56, 57, 1, 30, 31, 32; 2/463, 455
See application file for complete search history.

(56) References Cited

U.S. PATENT DOCUMENTS

| | | | | | |
|---|---|---|---|---|---|
| 147,264 | A * | 2/1874 | Hodgkins | A41C 3/144 | 2/92 |
| 862,376 | A * | 8/1907 | Bachman | A41C 3/144 | 450/57 |
| 2,593,711 | A * | 4/1952 | Weatherly | A41C 3/0035 | 2/247 |
| 2,753,565 | A * | 7/1956 | Holscher | A41C 3/10 | 450/72 |
| 5,716,255 | A * | 2/1998 | Abercrombie | A41C 3/12 | 2/267 |
| 6,517,410 | B1 * | 2/2003 | Underhill | A41C 3/0057 | 450/1 |
| 6,769,955 | B1 * | 8/2004 | Fisher | A41C 3/0035 | 2/267 |
| 7,001,239 | B2 * | 2/2006 | Russell | A45D 44/22 | 2/267 |
| 7,946,904 | B1 * | 5/2011 | Ciullo | A41C 3/0021 | 450/31 |
| 8,216,023 | B2 * | 7/2012 | Donnelly | A41C 3/0021 | 450/54 |

(Continued)

FOREIGN PATENT DOCUMENTS

| | | | |
|---|---|---|---|
| GB | 499583 | * | 1/1939 |
| GB | WO2009149529 | * | 12/2009 |

*Primary Examiner* — Gloria Hale
*Assistant Examiner* — Brieanna Szafran
(74) *Attorney, Agent, or Firm* — Barcelo, Harrison & Walker, LLP

(57) ABSTRACT

A novel brassiere includes an outer fabric garment comprising a shoulder strap and a back strap and a monolithic and contiguous breast support that may comprise a molded polymer material. The monolithic and contiguous polymer breast support includes a décolletage region, two breast cups, and an inter-breast region. An inter-breast thickness of the molded polymer material is at least four times greater than the thickness in the décolletage region or in either of the breast cups. The outward surfaces of the inter-breast and décolletage regions are preferably not convex.

22 Claims, 4 Drawing Sheets

(56) References Cited

U.S. PATENT DOCUMENTS

| | | | | |
|---|---|---|---|---|
| 8,708,772 | B2 * | 4/2014 | Fernandez Cuevas | A41C 3/005 2/267 |
| D704,920 | S * | 5/2014 | Altsuler | D2/706 |
| 2004/0198177 | A1 * | 10/2004 | Jankowski | A41C 3/0057 450/39 |
| 2007/0155283 | A1 * | 7/2007 | McQueer | A41C 3/0057 450/39 |
| 2009/0081925 | A1 * | 3/2009 | Shweky | A41C 3/0042 450/39 |
| 2009/0270013 | A1 * | 10/2009 | Clair | A41C 3/08 450/30 |
| 2011/0269375 | A1 * | 11/2011 | Fisher-Pacheco | A41F 1/006 450/57 |
| 2016/0120235 | A1 * | 5/2016 | Scotto | A41C 3/08 450/31 |

* cited by examiner

BRASSIERE FOR REDUCING SKIN WRINKLES IN DÉCOLLETAGE REGION OF CHEST

BACKGROUND

A brassiere, commonly referred to as a bra, is an article of clothing that covers, supports, and may elevate the breasts of a woman. Anatomically, the breasts are typically composed of fat tissue surrounding mammary glands, but may also include surgically-implanted augmentation or reconstruction material. The breasts also include overlying skin and some internal ligaments that help determine the breast shape, but many women prefer for their breasts to be additionally supported by a bra (typically worn as an undergarment) during daily and athletic activities.

Overnight, potentially unsightly wrinkles may develop in the décolletage or décolleté region of a woman's chest (e.g. at or above the sternum) due to sleep positioning of the breasts. For example, when a woman sleeps on her right or left side, one breast is gravitationally drawn to lie against the other, which may exacerbate such décolleté skin wrinkles after sleep, both for women who have undergone breast augmentation and also for those who have not. Many consumers of women's undergarments understand that décolleté skin wrinkles are generally considered to be undesirable.

For many years, certain specialized sleep bras containing inter-breast cushions or pads, and sleep accessories such as inter-breast pillows, have been proposed to separate the breasts during sleep and thereby inhibit the development of skin wrinkles in the décolletage region of a woman's chest. Therefore, the prior art has demonstrated a long-felt need in the industry for an invention to address this problem. However, the appearance during use of previous inter-breast pillows and specialized sleep bras for this purpose was often tolerable only to women who know that they would not be seen in their sleepwear (e.g. women who live alone). For example, hitherto proposed specialized sleep bras for the purpose of reducing décolleté skin wrinkles have had one or more unnatural or conspicuously outwardly protruding lumps, which limited their commercial success.

Hence, there remains a need in the art for a bra that can be comfortably worn while sleeping, that is structured to reduce the formation of wrinkles in the upper chest of a woman who sleeps on her side, and that has a natural appearance that is outwardly attractive to the wearer and to spouses, mates, friends, or roommates who may see the bra in use.

DETAILED DESCRIPTION OF EXAMPLE EMBODIMENTS

Figure 1:
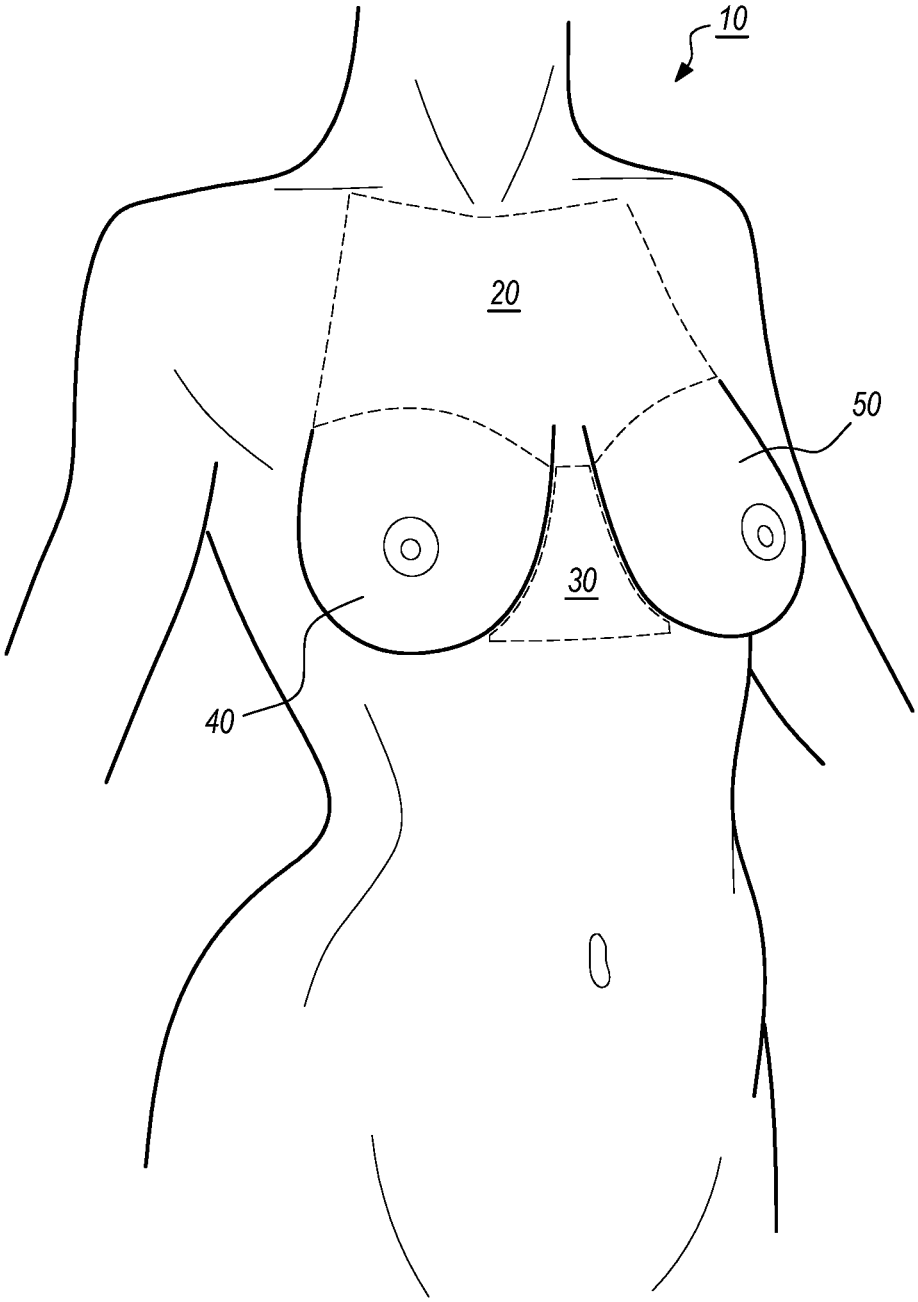
FIG. 1 graphically depicts the décolletage and inter-breast regions of a woman's body.

FIG. 1 is a front perspective view of a woman's body 10, with dashed lines to graphically distinguish the décolletage region 20 from an inter-breast region 30. The inter-breast region 30 is defined between the most protruding portions of the woman's breasts 40 and 50. The décolletage region 20 includes the neckline above the most protruding portions of breasts 40 and 50, and may also include an uppermost region between the breasts 40 and 50 (i.e. an upper cleavage region). However, the décolletage region 20 does not include the inter-breast portion 30 between the most protruding portions of the breasts 40 and 50. In the example of FIG. 1, the inter-breast region 30 increases in width from its top to its bottom. However, the size and shape of the décolletage region 20 and of the inter-breast region 30 are expected to vary from woman to woman, because of the expected diversity in the sizes and shapes of woman's breasts and bodies in a population.

Figure 2:
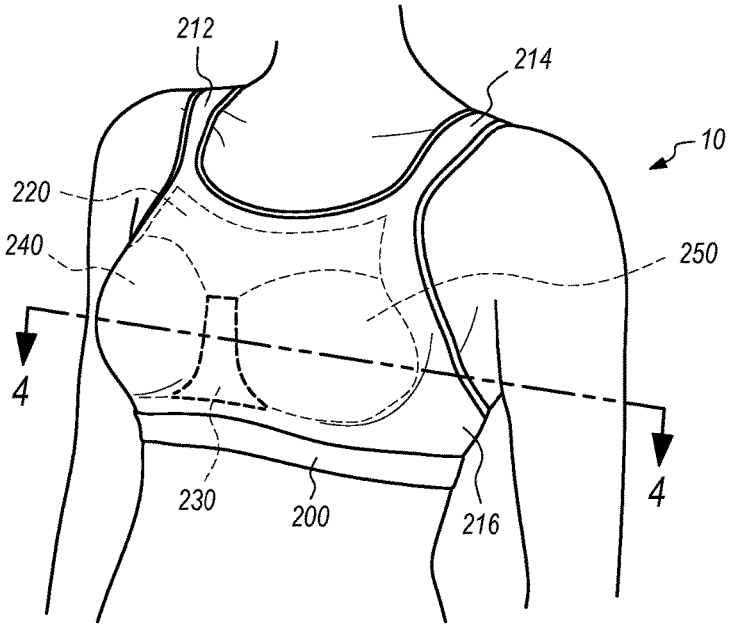
FIG. 2 depicts a brassiere according to an embodiment of the present invention, in the position of use by a woman.
Figure 3:
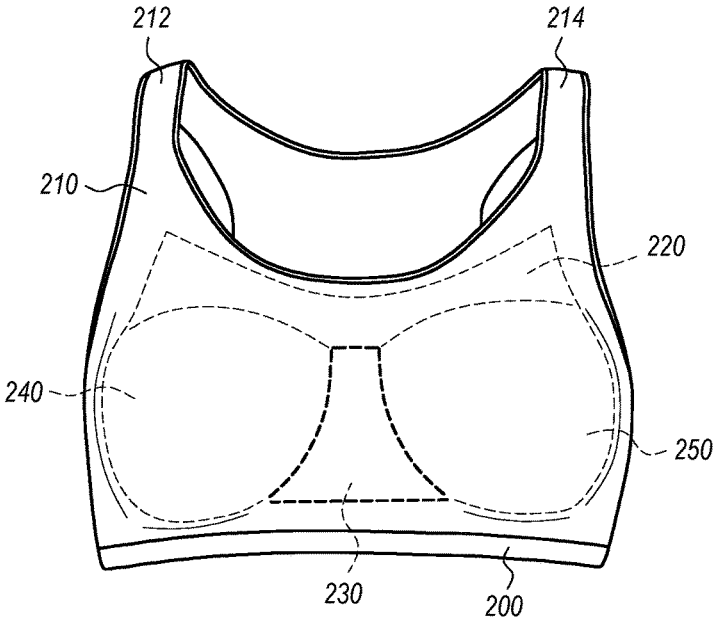
FIG. 3 is a front view of a brassiere according to an embodiment of the present invention.
Figure 4:
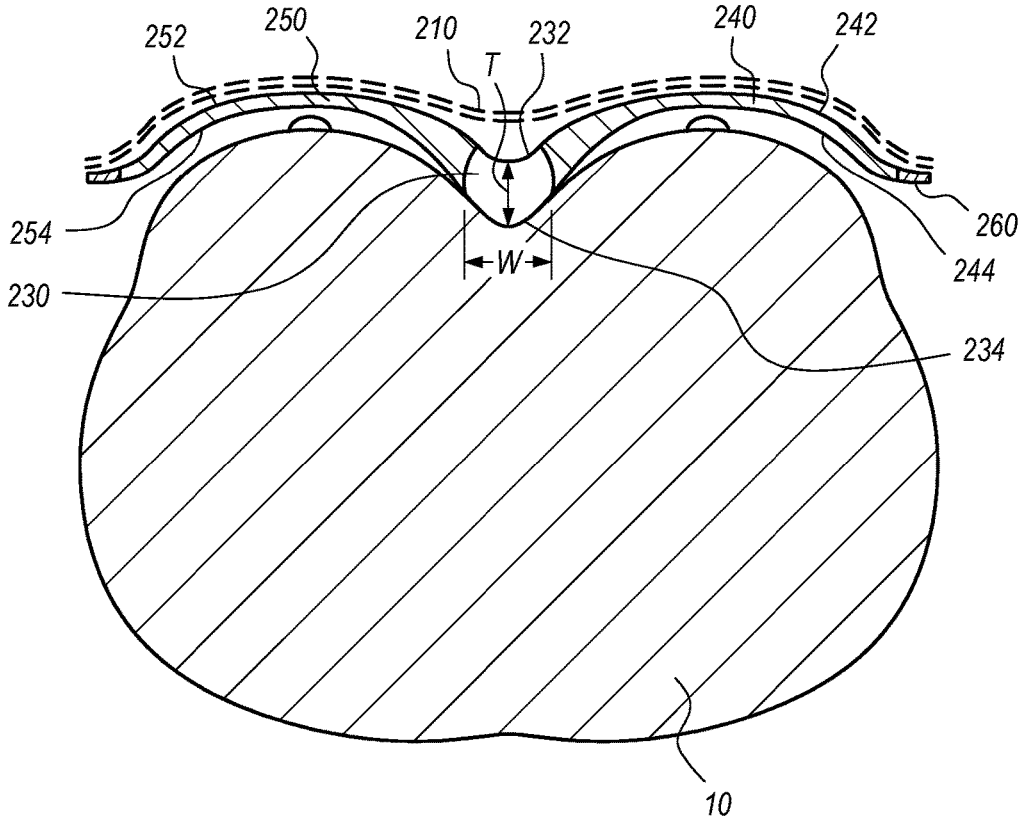
FIG. 4 is a cross-sectional view of a brassiere according to an embodiment of the present invention, in the position of use by a woman.

FIG. 2 depicts a brassiere 200 according to an embodiment of the present invention, in a position of use on a woman's body 10. FIG. 3 is a front view of the brassiere 200. FIG. 4 is a horizontal cross-sectional view of the brassiere 200, in a position of use on the woman's body 10, with the cross-section being taken at a height labeled as 4-4 in FIG. 2. Now referring to FIGS. 2-4, the brassiere 200 includes an outer fabric garment 210 that may have shoulder straps 212, 214 and a back strap 216. In certain embodiments, the outer fabric garment 210 may include fibers that comprise polyester, nylon, cotton, a polyester-polyurethane copolymer, an aliphatic polyamide, or a semi-aromatic polyamide.

In the embodiment of FIGS. 2-4, the brassiere 200 may also include a monolithic and contiguous breast support 260 comprising a molded polymer material. In certain embodiments, the molded polymer material may comprise a natural or synthetic rubber, such as a polyurethane-based foam rubber, polychloroprene, or the like.

In certain embodiments, the monolithic and contiguous breast support 260 may include a décolletage region 220 defining a first thickness (e.g. of a molded polymer material). In certain embodiments, the décolletage region 220 of the monolithic and contiguous breast support 260 may correspond to a region of the monolithic and contiguous breast support 260 that overlaps with the décolletage region 20 of the woman's body 10 that is shown in FIG. 1. Accordingly, in low-cut embodiments where the décolletage region 220 of the monolithic and contiguous breast support 260 does not overlap very much with the décolletage region 20 of the woman's body 10, the décolletage region 220 may be narrow with a mostly horizontally-oriented aspect.

In the embodiment of FIGS. 2-4, the monolithic and contiguous breast support 260 also includes a right breast cup 240 and a left breast cup 250. In certain embodiments, the right and left breast cups 240, 250 of the monolithic and contiguous breast support 260 may correspond to regions of the monolithic and contiguous breast support 260 that overlap with the right and left breasts 40, 50 of the woman's body 10 that is shown in FIG. 1.

In certain embodiments, the upper and outer extents of the monolithic and contiguous breast support 260 may extend further than the example depicted (e.g. the upper extent of the décolletage region 220 may extend all the way up to the collar of the outer fabric garment 210, and/or the leftmost and rightmost edges of the right and left breast cups 240, 250 may extend further laterally, to span or even wrap partially around the front of the woman's body 10). In certain embodiments, this may be done to make the underlying presence of the monolithic and contiguous breast support 260, beneath the outer fabric garment 210, less conspicuous.

As shown in FIG. 4, the left breast cup 250 may include a left outward convex surface 252 facing and possibly in contact with the outer fabric garment 210. The left breast cup 250 may also include a left inward breast-receiving cavity 254. A second thickness of the molded polymer material (of the monolithic and contiguous breast support 260) may be defined between the left outward convex surface 252 and the left inward breast-receiving cavity 254. In certain embodiments, the second thickness may preferably be measured near a centralized nipple region of the left breast cup 250, rather than in a lower region of the left breast cup 250. A more representative thickness of the left breast cup 250 may thereby be measured, since a lower region of the left breast cup 250 may optionally be thickened (for example by including an additional layer or gel-filled cavity), for example if it desired to push the breasts upwards for aesthetic effect.

Also as shown in FIG. 4, the right breast cup 240 may include a right outward convex surface 242 facing and possibly in contact with the outer fabric garment 210. The right breast cup 240 may also include a right inward breast-receiving cavity 244. A third thickness of the molded polymer material (of the monolithic and contiguous breast support 260) may be defined between the right outward convex surface 242 and the right inward breast-receiving cavity 244. In certain embodiments, the third thickness may preferably be measured near a centralized nipple region of the right breast cup 244, rather than in a lower region of the right breast cup 244. A more representative thickness of the right breast cup 244 may thereby be measured, since a lower region of the right breast cup 244 may optionally be thickened (for example by including an additional layer or gel-filled cavity), for example if it desired to push the breasts upwards for aesthetic effect.

In the embodiment of FIGS. 2-4, the monolithic and contiguous breast support 260 also includes an inter-breast region 230 between the right and left breast cups 240, 250. In certain embodiments, the inter-breast region 230 of the monolithic and contiguous breast support 260 may correspond to a region of the monolithic and contiguous breast support 260 that overlaps with the inter-breast region 30 of the woman's body 10 that is shown in FIG. 1. As shown in FIG. 4, the inter-breast region 230 of the monolithic and contiguous breast support 260 may include an inter-breast inward surface 234 that faces the wearer of the brassiere 200. In certain embodiments, the inter-breast inward surface 234 may be convex to better conform to the woman's body 10.

In the context of the embodiment of FIGS. 2-4, the monolithic and contiguous breast support 260 is considered to be monolithic and contiguous because its décolletage region 220, its inter-breast region 230, and its right and left breast cups 240, 250, are all regions of a single molded component with material continuity, rather than being an assembly of separately formed subcomponents. However, the monolithic and contiguous breast support 260 may include holes, jagged edges, cut-outs, openings, creases, cavities filled with gel, additional layers, corners, stitch lines, thickness changes, folds, etc., so long as the décolletage region 220, the inter-breast region 230, and the right and left breast cups 240, 250, of a particular layer are all regions of a single molded component with material continuity, rather than being an assembly of separately formed subcomponents.

As shown in the embodiment of FIG. 4, the inter-breast region 230 of the monolithic and contiguous breast support 260 may include an inter-breast outward surface 232 that faces the outer fabric garment 210. The inter-breast outward surface 232 is preferably not convex, for example to improve its aesthetic appearance. In this context, a surface may be considered to be "not convex" if such surface is flat, concave, not noticeably convex, or lacking any noticeable outwardly protruding lump(s). Here, outward may refer to a direction that is normal to and away from a surface of the woman's body 10, in this context typically the forward direction generally from the front of her body 10.

Still referring to FIGS. 2-4, in certain embodiments an outward surface of the décolletage region 220 of the monolithic and contiguous breast support 260 (e.g. the surface of the décolletage region 220 of the monolithic and contiguous breast support 260 that faces the outer fabric garment 210) is preferably also not convex.

In certain embodiments, the inter-breast region 230 of the monolithic and contiguous breast support 260 preferably defines an inter-breast thickness T of the molded polymer material that is at least four times greater than the first thickness. In this context, these thicknesses may be defined as being measured in the front-back direction of the woman's body 10, for example, in a direction that would be normal to her chest at a sternum location between the breasts.

As shown in FIG. 4, the inter-breast region 230 of the monolithic and contiguous breast support 260 may define a width W. In this context the width W may be measured laterally in the between-breasts direction of the woman's body 10, for example parallel to her chest at a sternum location between the breasts. In certain embodiments the width W of the inter-breast region 230 may preferably be in the range of 1 cm to 5 cm. The width W of the inter-breast region 230 of the monolithic and contiguous breast support 260 may optionally be constant, but in the embodiment FIGS. 2-4 it is preferably non-constant (i.e. preferably changes depending on the height at which it is measured). For example, the width W may preferably increase with increasing distance from the décolletage region 220, so that W may increase with decreasing height at which the cross section 4-4 is taken.

In certain embodiments, the inter-breast thickness T may preferably be in the range of 2 cm to 10 cm. In certain embodiments, the first thickness may preferably be in the range 1 mm to 10 mm. In certain embodiments, each of the second and third thicknesses may preferably be in the range of 1 mm to 20 mm. In certain embodiments, the second and third thicknesses optionally may be equal, or the first, second, and third thicknesses optionally may be equal. In certain embodiments, the structure of the monolithic and contiguous breast support 260, or the foregoing thickness ranges or relationships, may improve user comfort while sleeping, help reduce the formation of wrinkles in the décolletage region 20 of a woman's body 10 after she sleeps on her side, and/or improve the outwardly attractiveness of the brassiere 200.

Figure 5:
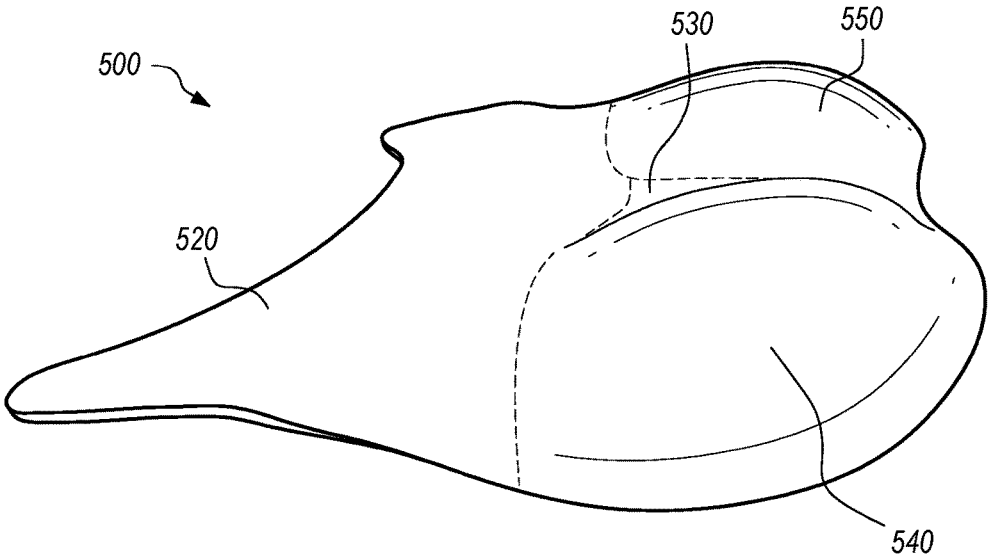
FIG. 5 is an outer perspective view of a molded breast support for a sleep accessory or brassiere, according to an embodiment of the present invention.
Figure 6:
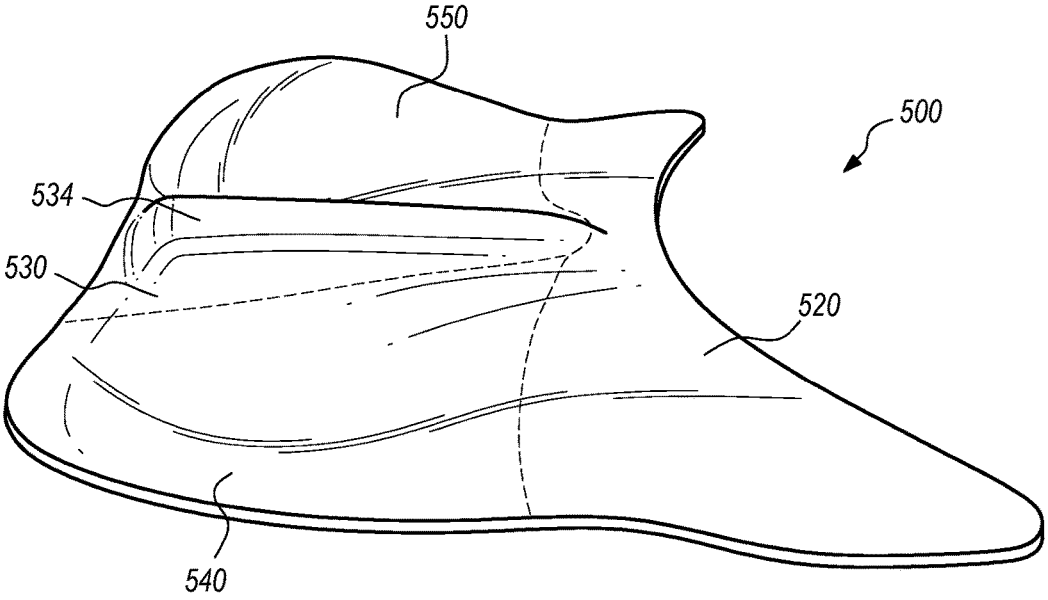
FIG. 6 is an inner perspective view of the molded breast support of FIG. 5.

FIG. 5 is an outer perspective view of a monolithic and contiguous breast support 500 for a sleep accessory or brassiere, according to an embodiment of the present invention. FIG. 6 is an inner perspective view of the monolithic and contiguous breast support 500. In the embodiment of FIGS. 5-6, the monolithic and contiguous breast support 500 is preferably molded from a polymer material such as a natural or synthetic rubber (e.g. polyurethane-based foam rubber, polychloroprene, or the like).

In certain embodiments, the monolithic and contiguous breast support 500 may include a décolletage region 520 corresponding to a region of the monolithic and contiguous breast support 500 that overlaps with the décolletage region 20 of the woman's body 10 that is shown in FIG. 1. Accordingly, in low-cut embodiments where the décolletage region 520 of the monolithic and contiguous breast support 500 does not overlap very much with the décolletage region 20 of the woman's body 10, the décolletage region 520 may be narrow with a mostly horizontally-oriented aspect.

In the embodiment of FIGS. 5-6, the monolithic and contiguous breast support 500 also includes a right breast cup 540 and a left breast cup 550. In certain embodiments, the right and left breast cups 540, 550 of the monolithic and contiguous breast support 500 may correspond to regions of the monolithic and contiguous breast support 500 that overlap with the right and left breasts 40, 50 of the woman's body 10 that is shown in FIG. 1.

As shown in FIG. 5, the left breast cup 250 may include a left outward convex surface and the right breast cup 540 may include a right outward convex surface. As shown in FIG. 6, the right breast cup 540 and the left breast cup 550 may each include concave inward breast-receiving cavities, for example to receive and support the right and left breasts 40, 50 of the woman's body 10 that is shown in FIG. 1.

In the embodiment of FIGS. 5-6, the monolithic and contiguous breast support 500 also includes an inter-breast region 530 between the right and left breast cups 540, 550. In certain embodiments, the inter-breast region 530 of the monolithic and contiguous breast support 500 may correspond to a region of the monolithic and contiguous breast support 500 that overlaps with the inter-breast region 30 of the woman's body 10 that is shown in FIG. 1. As shown in FIG. 6, the inter-breast region 530 of the monolithic and contiguous breast support 500 may include an inter-breast inward surface 534 that protrudes inwardly, for example between the right and left breasts 40, 50 of the woman's body 10 that is shown in FIG. 1. In certain embodiments, the inter-breast inward surface 534 may be convex to better conform to the woman's body 10.

In the context of the embodiment of FIGS. 5-6, the monolithic and contiguous breast support 500 is considered to be monolithic and contiguous because its décolletage region 520, its inter-breast region 530, and its right and left breast cups 540, 550, are all regions of a single molded component with material continuity, rather than being an assembly of separately formed subcomponents. However, the monolithic and contiguous breast support 500 may include holes, jagged edges, cut-outs, openings, creases, corners, stitch lines, thickness changes, folds, etc., so long as the décolletage region 520, the inter-breast region 530, and the right and left breast cups 540, 550, are all regions of a single molded component with material continuity, rather than being an assembly of separately formed subcomponents.

As shown in the embodiment of FIG. 5, an outward surface of the inter-breast region 530 is preferably not convex, for example to improve its aesthetic appearance. In certain embodiments an outward surface of the décolletage region 520 of the monolithic and contiguous breast support 500 is preferably also not convex. In certain embodiments, a thickness of the inter-breast region 530 of the monolithic and contiguous breast support 500 is preferably at least four times greater than that of the décolletage region 520, or the right or left breast cups 540, 550. In this context, these thicknesses may be defined as being measured in the front-back direction of the woman's body 10, for example, in a direction that would be normal to her chest at a sternum location between the breasts 40, 50 shown in FIG. 1.

In certain embodiments, the structure of the monolithic and contiguous breast support 500 and the foregoing thickness relationship may improve user comfort while sleeping, help reduce the formation of wrinkles in the décolletage region 20 of a woman's body 10 after she sleeps on her side, and/or improve the outwardly attractiveness of the a sleep accessory or brassiere.

In the foregoing specification, the invention is described with reference to specific exemplary embodiments, but those skilled in the art will recognize that the invention is not limited to those. It is contemplated that various features and aspects of the invention may be used individually or jointly and possibly in a different environment or application. The specification and drawings are, accordingly, to be regarded as illustrative and exemplary rather than restrictive. For example, the word "preferably," and the phrase "preferably but not necessarily," are used synonymously herein to consistently include the meaning of "not necessarily" or optionally. "Comprising," "including," and "having," are intended to be open-ended terms.

I claim:

1. A brassiere, comprising:

an outer fabric garment comprising a shoulder strap and a back strap;

a monolithic and contiguous breast support, including:

a décolletage region defining a first thickness of the monolithic and contiguous breast support;

a left breast cup including a left outward convex surface in contact with the outer fabric garment, and a left inward breast-receiving cavity, a right breast cup including a right outward convex surface in contact with the outer fabric garment, and a right inward breast-receiving cavity, an inter-breast region between the left and right breast cups, including an inter-breast outward surface that faces the outer fabric garment, and defining an inter-breast thickness of the monolithic and contiguous breast support that is at least four times greater than the first thickness;

wherein the inter-breast outward surface is not convex.

2. The brassiere of claim 1 wherein the décolletage region includes a décolletage outward surface that faces the outer fabric garment, and the décolletage outward surface is not convex.

3. The brassiere of claim 2 wherein neither the inter-breast outward surface nor the décolletage outward surface includes an outward protrusion.

4. The brassiere of claim 1 wherein the left breast cup defines a second thickness of the monolithic and contiguous breast support between the left outward convex surface and the left inward breast-receiving cavity, and the right breast cup defines a third thickness of the monolithic and contiguous breast support between the right outward convex surface and the right inward breast-receiving cavity, and the second thickness is equal to the third thickness.

5. The brassiere of claim 4 wherein each of the second and third thicknesses is in the range of 1 mm to 20 mm.

6. The brassiere of claim 1 wherein the first thickness is in the range of 1 mm to 10 mm, and the inter-breast thickness is in the range of 2 cm to 10 cm.

7. The brassiere of claim 1 wherein the inter-breast thickness is in the range of 2 cm to 10 cm.

8. The brassiere of claim 1 wherein the inter-breast thickness increases with increasing distance from the décolletage region.

9. The brassiere of claim 1 wherein a width of the inter-breast region is in the range of 1 cm to 5 cm.

10. The brassiere of claim 9 wherein the width of the inter-breast region increases with increasing distance from the décolletage region.

11. The brassiere of claim 1 wherein the outer fabric garment additionally comprises a second shoulder strap.

12. The brassiere of claim 1 wherein the inter-breast region includes an inter-breast inward surface that is opposite the inter-breast outward surface, and wherein the inter-breast inward surface is convex.

13. The brassiere of claim 1 wherein the monolithic and contiguous breast support comprises a molded polymer material.

14. The brassiere of claim 13 wherein the molded polymer material comprises a natural or synthetic rubber.

15. The brassiere of claim 13 wherein the molded polymer material comprises polychloroprene or a polyurethane-based foam rubber.

16. The brassiere of claim 1 wherein the outer fabric garment comprises fibers selected from the group consisting of polyester, cotton, nylon, a polyester-polyurethane copolymer, an aliphatic polyamide, and a semi-aromatic polyamide.

17. A sleep accessory comprising a monolithic and contiguous breast support, the monolithic and contiguous breast support comprising:

a décolletage region defining a first thickness of the monolithic and contiguous breast support;

a left breast cup including a left outward convex surface and a left inward breast-receiving cavity;

a right breast cup including a right outward convex surface and a right inward breast-receiving cavity;

an inter-breast region between the left and right breast cups that defines an inter-breast thickness of the monolithic and contiguous breast support that is at least four times greater than the first thickness;

wherein an outward surface of the inter-breast region is not convex.

18. The sleep accessory of claim 17 wherein the monolithic and contiguous breast support comprises a molded polymer material.

19. The sleep accessory of claim 17 wherein the left breast cup defines a second thickness of the monolithic and contiguous breast support between the left outward convex surface and the left inward breast-receiving cavity, and the right breast cup defines a third thickness of the monolithic and contiguous breast support between the right outward convex surface and the right inward breast-receiving cavity, and the second thickness is equal to the third thickness.

20. The sleep accessory of claim 19 wherein the first thickness is in the range of 1 mm to 10 mm, and the inter-breast thickness is in the range of 2 cm to 10 cm.

21. The sleep accessory of claim 17 wherein the décolletage region includes a décolletage outward surface that is not convex.

22. The sleep accessory of claim 17 wherein a width of the inter-breast region is in the range of 1 cm to 5 cm.

* * * * *